US006267486B1

(12) United States Patent
Tai

(10) Patent No.: US 6,267,486 B1
(45) Date of Patent: Jul. 31, 2001

(54) LOCATORS IN A NET-SHAPED CHRISTMAS LIGHT ASSEMBLY

(76) Inventor: Chin-Lien Tai, No.2 Lane 272 Pun Diing Road, Hsinchu City (TW)

( * ) Notice: Subject to any disclaimer, the term of this patent is extended or adjusted under 35 U.S.C. 154(b) by 0 days.

(21) Appl. No.: 09/495,870

(22) Filed: Feb. 2, 2000

(51) Int. Cl.[7] ..... F21V 19/00; F21W 121/00
(52) U.S. Cl. ..... 362/249; 362/391; 362/806
(58) Field of Search ..... 362/226, 227, 362/249, 252, 391, 396, 806

(56) References Cited

U.S. PATENT DOCUMENTS 5,791,765 * 8/1998 Lin ..... 362/249
5,941,628 * 8/1999 Chang ..... 362/249
6,048,077 * 4/2000 Pan ..... 362/249
6,059,425 * 5/2000 Wang ..... 362/249
6,106,138 * 8/2000 Wei ..... 362/252
6,190,021 * 2/2001 Huang ..... 362/227

* cited by examiner

*Primary Examiner*—Alan Cariaso
(74) *Attorney, Agent, or Firm*—Bacon & Thomas, PLLC

(57) ABSTRACT

A net-shaped Christmas light assembly comprises locators, light bulbs, and electric wires. Each locator is composed of a cylindrical seat, two opposite bases, a semicircular engaging ring and double flip engaging hooks. The cylindrical seat has two semicircular enclosing part, two semicircular bases, and an elongated guide hole between the bases. The engaging ring and the double flip engaging hooks are disposed on the cylindrical seat and opposite to each other. The electric wires passes through the double flip engaging hooks and the engaging ring. The connectors on light bulbs are manually fitted with cylindrical seat firmly so as to set up the net-shaped Christmas light assembly.

1 Claim, 5 Drawing Sheets

LOCATORS IN A NET-SHAPED CHRISTMAS LIGHT ASSEMBLY

BACKGROUND OF THE INVENTION

1. Field of the Invention

The present invention relates to locators in a net-shaped Christmas light assembly, and particularly to locators for light bulbs, which are able to link with one another manually by way of electric wires to form a net of Christmas light assembly for hanging on any article decoratively.

2. Description of Related Art

Generally, each locator in a prior art Christmas light assembly has a central locating hole with a semicircular engaging ring at both ends thereof respectively. The engaging ring has to be inserted two electric wires and the locating hole has to be fitted with a connector. The locators arranging in the prior art Christmas light assembly have the following drawbacks:

(1) It is not easy to insert the electric wires into the semicircular engaging rings manually.

(2) A pair of pliers has to be used to clamp the electric wires while inserting the electric wires into the engaging rings. It is apt to hurt the insulating outer skins of the wires and damage the wires such that an electric shock may occur unavoidably.

(3) The connector of the light bulb is received in the locating hole of the locator and it is for the connector to move away the locator in case of the electric wires attaching the connector being pulled.

SUMMARY OF THE INVENTION

An object of the present invention is to provide a plurality of locators in a net-shaped Christmas light assembly and each of the locators is possible for the electric wires to insert into handily.

Another object of the present invention is to provide a plurality of locators in a net-shaped Christmas light assembly with which the electric wires are not possible to be damaged during an assembly job and an electric shock can be avoided.

A further object of the present invention is to provide a plurality of locators in a net-shaped Christmas light assembly with which the connectors on light bulbs are disposed in the locators firmly.

BRIEF DESCRIPTION OF THE DRAWINGS

The present invention can be more fully understood by referring to the following description and accompanying drawings, in which.

DETAILED DESCRIPTION OF THE PREFERRED EMBODIMENT

Figure 1:
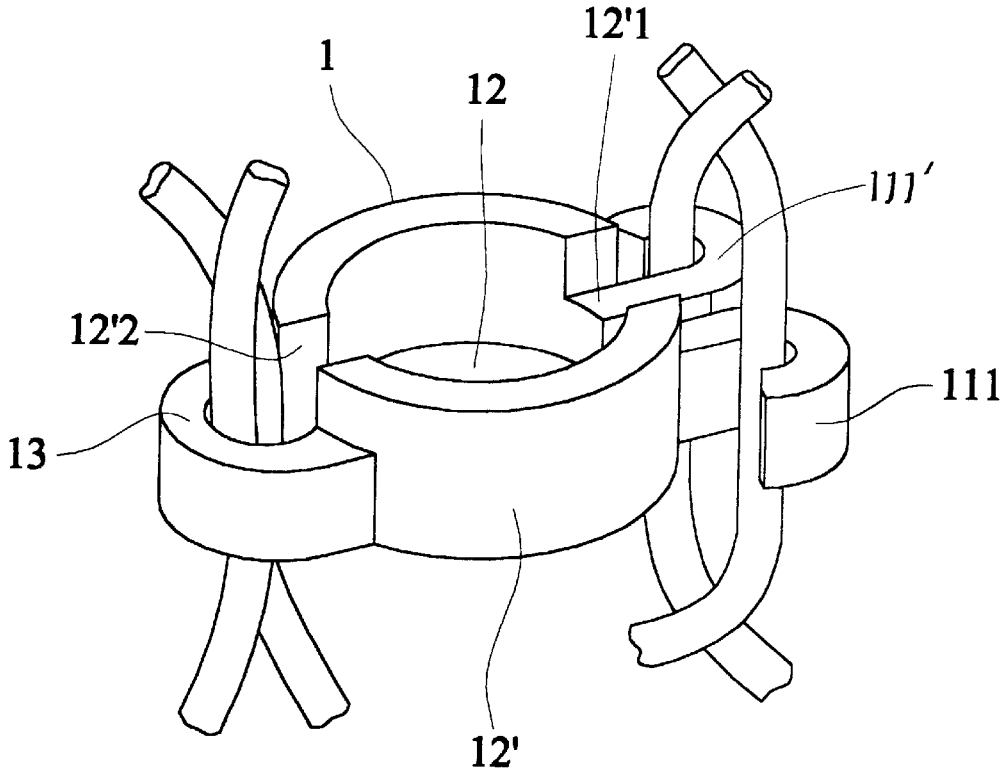
FIG. 1 is a perspective view of one of the connectors in a net-shaped Christmas light assembly according to the present invention.
Figure 2A:
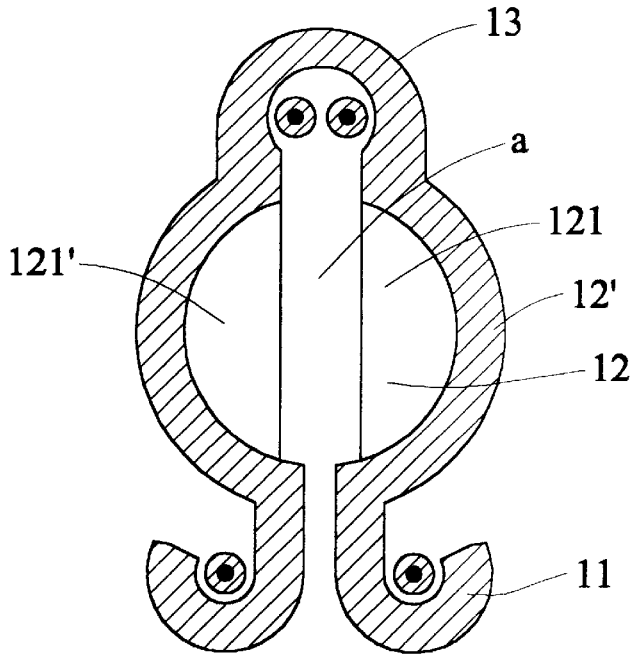
FIG. 2A is a top sectional view of the connector shown in FIG. 1.
Figure 2B:
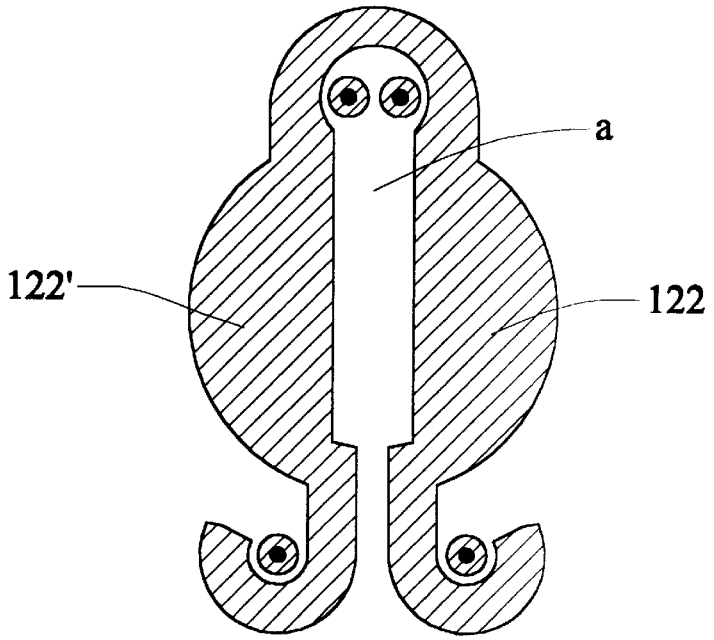
FIG. 2B is a bottom sectional view of the connector shown in FIG. 1.
Figure 3:
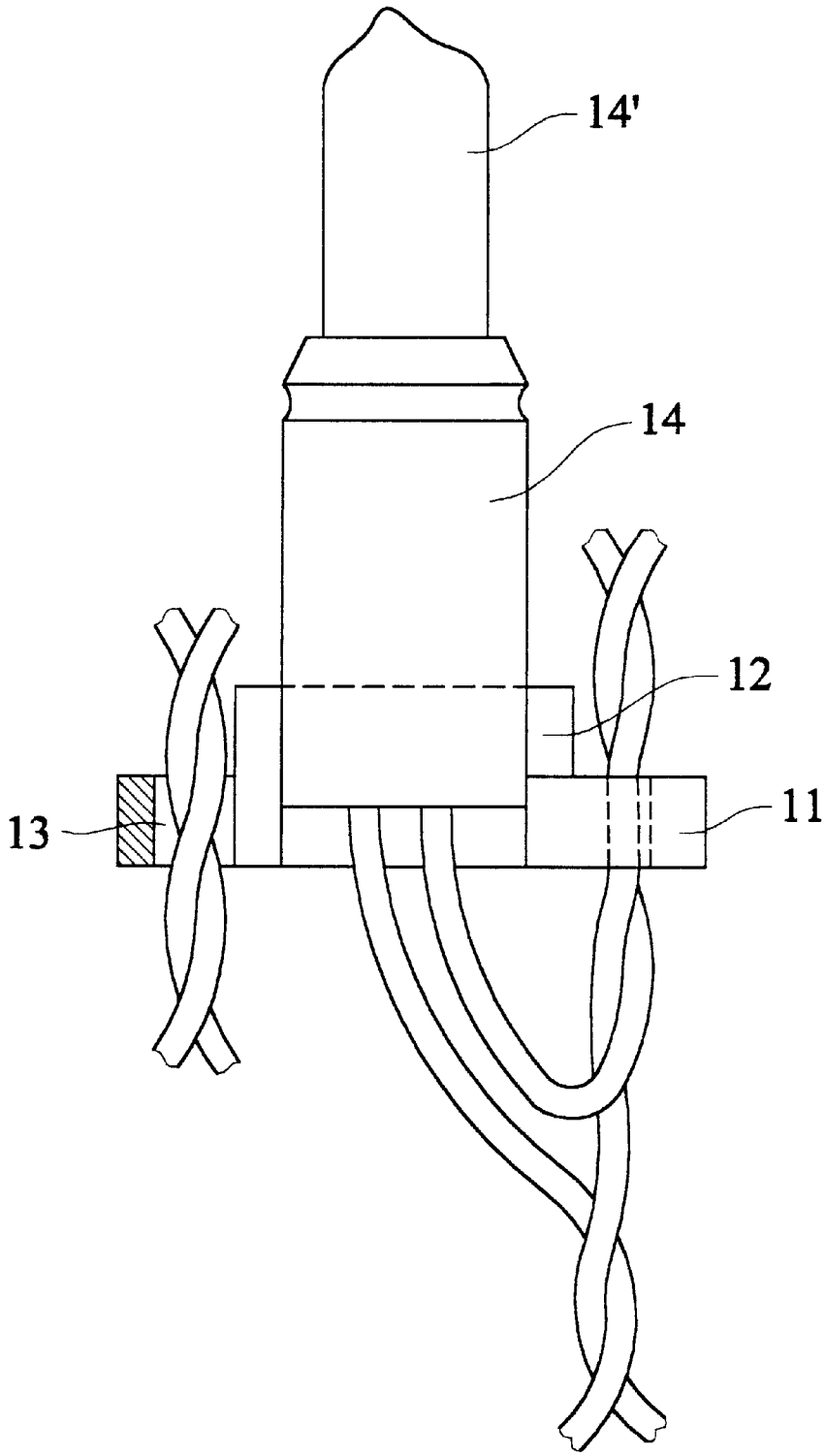
FIG. 3 is a plan view of the connector shown in FIG. 1 engaging with a light bulb in a net-shaped Christmas light assembly.

Referring to FIGS. 1 to 6, an embodiment of the present invention is illustrated. It can be seen in FIGS. 1 and 2 that one locator 1 in a net-shaped Christmas light assembly 2 (shown in FIG. 5) has a semicircular engaging ring 13 at the left thereof and double flip engaging hooks 11 at the right thereof. The central part of the locator 1 is a cylindrical seat 12 for being inserted by a light bulb 14' (shown in FIGS. 3 and 4). The cylindrical seat 12 has two opposite recess openings 12'1, 12'2 such that the engaging ring 13 is located at the recess opening 12'2 and the double flip engaging hooks are located at the recess opening 12'1. The cylindrical seat 12 composed of semicircular bases 121, 121', and the semicircular bases are provided with a respective bottom part 122, 122' to support a connector 14 on the light bulb 14' (shown in FIGS. 3 and 4). In this way, the connector 14 will keep unmoved from the cylindrical seat 12 while a pulling down force is exerted to the connector Referring to FIGS. 3 and 4 again, when the light bulb 14' moves toward the direction of downward allow sign, the connector 14 fits with the semicircular bases 121, 121' and two opposite semicircular part 12' support the connector 14 firmly to prevent from shaking. An elongated guide hole (a) is disposed between the two semicircular bases 121, 121' to allow the electric wires moving in the guide hole (a) such that the electric wires can be confined in an engaging ring 13. In addition, double flip engaging hooks 11 are disposed on the cylindrical seat 12 opposite to the engaging ring 13 and each engaging hook 11 has a retaining hook part 111, 111' to hold an electric wire respectively for easing assembling job.

Figure 6:
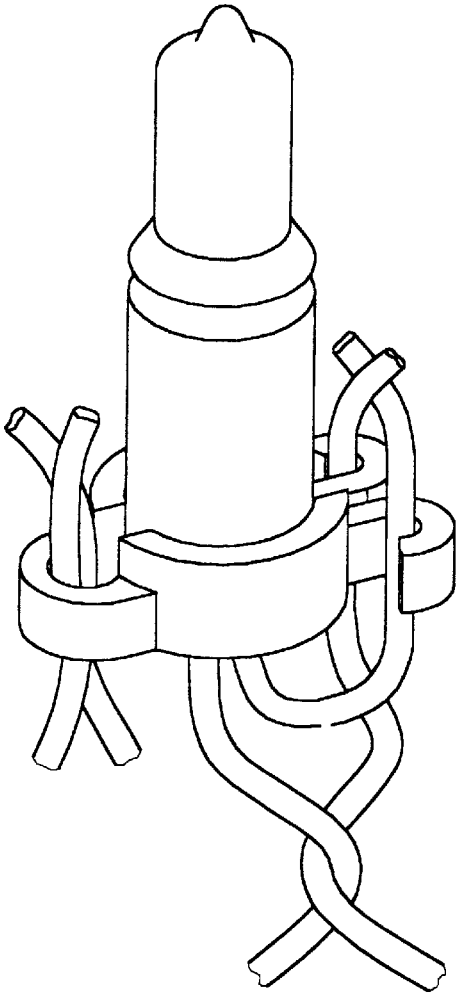
FIG. 6 is an enlarged perspective view of the enclosed part 6 shown in FIG. 5.
Figure 4:
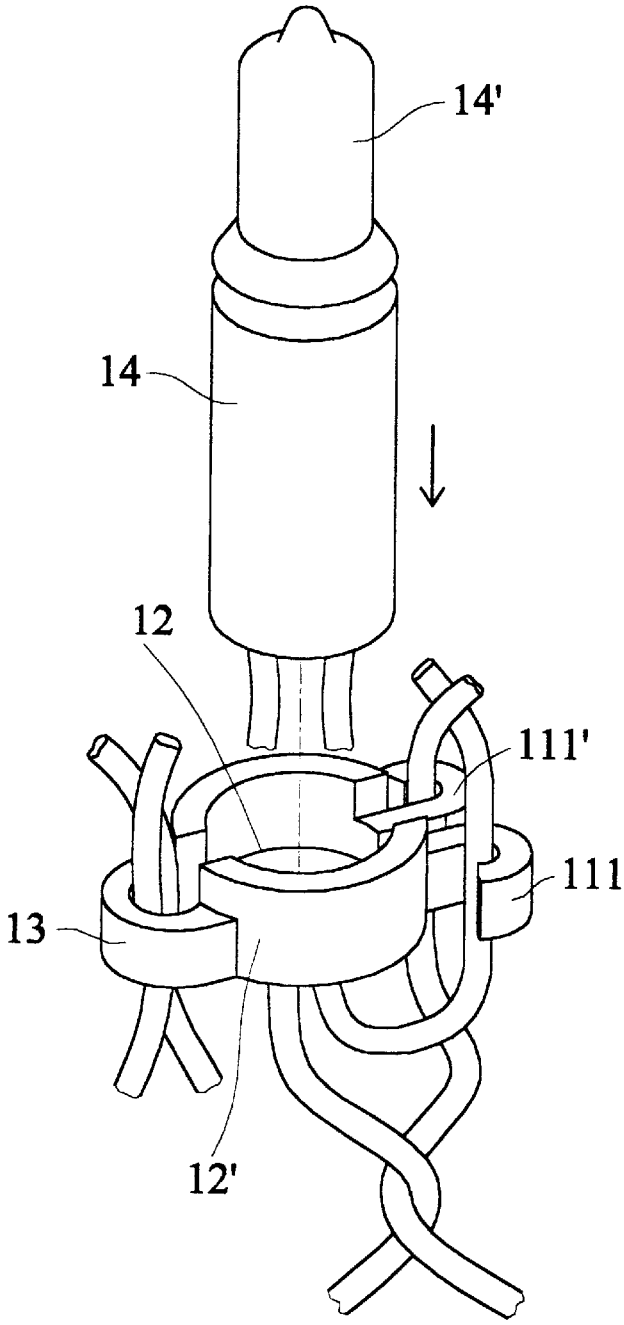
FIG. 4 is a perspective view of the connector shown in FIG. 1 and a light bulb, illustrating in the process of inserting into the connector.
Figure 5:
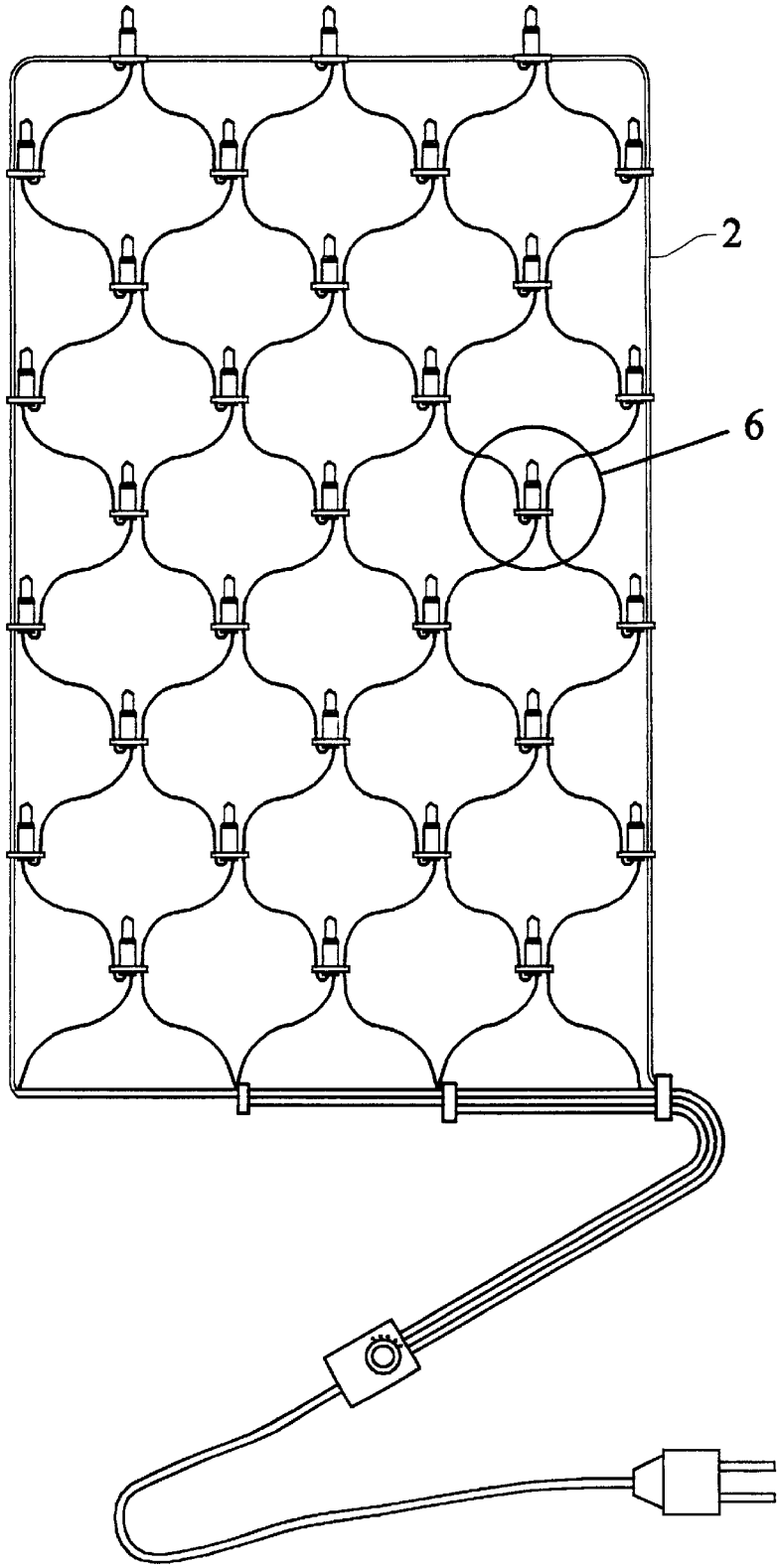
FIG. 5 is a plan view of an embodiment of the net-shaped Christmas light assembly.

Referring to FIG. 5, the net-shaped Christmas light assembly 2 has a plurality of locators of the present invention linked with each other and the enclosing part 6 is one of the locators engaging a light bulb. FIG. 6 shows an enlarged perspective view of the part 6 in FIG. 5.

It is appreciated that the net-shaped Christmas light assembly 2 associated with the locators of the present invention has the following advantages:

1. It is easy to set up the locators associated with the light bulbs because the elongated guide hole, the double flip engaging ring, the semicircular engaging ring, and the cylindrical seat are designed to allow the net-shaped Christmas light assembly being set up manually without any hand tool.

2. The light bulbs fit with the locators firmly because cylindrical seat provides semicircular bottoms and enclosing part such that the locator can be inserted the connector without inclining and loosening.

3. It is much safer because the electric wires are inserted into the locator without the need of being clamped by pliers, the insulation skins of the electric wires may not be hurt and an electric shock will not occur.

While the present invention has been described with reference to a preferred embodiment thereof, it is to be understood that modifications and variations may be easily made without departing from the spirit of this invention, which is defined by the appended claim.

What is claimed is:

1. A net-shaped Christmas light assembly comprising:

a plurality of locators;

a plurality of light bulbs, each of said plurality of light bulbs being provided with a connector to insert into each of said plurality of locators; and a plurality of electric wires, said plurality of electric wires connecting said light bulbs and linking said locators; characterized in that each of said locators further comprising:

a cylindrical seat, having two opposite recess openings to constitute two semicircular enclosing part, two opposite bases, and an elongated guide hole between said two bases;

a semicircular engaging ring with a enclosed hole, being located at one of said recess openings to be inserted the electric wires for forming a net;

double flip engaging hooks, being located at the other one of said recess openings to hook the electric wires respectively for further forming the net;

whereby, the electric wires passes through the double flip engaging hooks first, then enter the engaging ring via the elongated guide hole, the connectors of the light bulbs are manually fitted with cylindrical seat firmly, and the net-shaped Christmas light assembly is completely assembled.

* * * * *